United States Patent [19]

Ziehbrunner

[11] Patent Number: 4,646,502

[45] Date of Patent: Mar. 3, 1987

[54] PANEL CONSTRUCTION ELEMENT AND BUILDING CONSTRUCTION SYSTEM EMPLOYING SUCH CONSTRUCTION ELEMENTS

[75] Inventor: Heini Ziehbrunner, Buchs, Switzerland

[73] Assignee: Marco Vasella, Zurich, Switzerland

[21] Appl. No.: 701,016

[22] Filed: Feb. 12, 1985

[30] Foreign Application Priority Data

Jul. 24, 1984 [CH] Switzerland ..... 3590/84

[51] Int. Cl.[4] ..... E04C 2/34; E04C 2/38

[52] U.S. Cl. ..... 52/580; 52/468; 52/471; 52/656; 52/785; 52/809; 52/810; 52/827

[58] Field of Search ..... 52/810, 821, 809, 785, 52/580, 465, 468, 469, 471, 470, 656, 827

[56] References Cited

U.S. PATENT DOCUMENTS

| | | | |
|---|---|---|---|
| 2,228,363 | 1/1941 | Pinney | 52/580 |
| 2,232,762 | 2/1941 | Batcheller | 52/468 |
| 2,825,674 | 3/1958 | Prase | 52/785 |
| 3,235,040 | 2/1966 | Ellis | 52/809 |
| 3,334,464 | 8/1967 | Charles | 52/809 |
| 3,356,403 | 12/1967 | Sak et al. | 52/580 |
| 3,685,222 | 8/1972 | Curtess | 52/580 |
| 3,835,611 | 9/1974 | Villeger | 52/809 |
| 3,871,153 | 3/1975 | Birum, Jr. | 52/809 |
| 3,971,075 | 7/1976 | Heinbaugh et al. | 52/471 |
| 4,295,305 | 10/1981 | Shelver | 52/656 |
| 4,316,352 | 2/1982 | Harrington et al. | 52/656 |
| 4,364,203 | 12/1982 | Seaholm et al. | 52/821 |
| 4,548,003 | 10/1985 | Johansson et al. | 52/785 |

FOREIGN PATENT DOCUMENTS

| | | | |
|---|---|---|---|
| 218538 | 12/1956 | Australia | 52/809 |
| 40589 | 10/1973 | Australia . | |
| 2323311 | 11/1974 | Fed. Rep. of Germany | 52/580 |
| 2912003 | 10/1980 | Fed. Rep. of Germany . | |
| 3225513 | 2/1984 | Fed. Rep. of Germany . | |
| 1464864 | 1/1967 | France | 52/809 |
| 2366416 | 4/1978 | France . | |
| 625161 | 9/1961 | Italy | 52/809 |

*Primary Examiner*—William F. Pate, III
*Assistant Examiner*—Michael Safavi
*Attorney, Agent, or Firm*—Werner W. Kleeman

[57] ABSTRACT

The construction element comprises a profile frame, a filler material and two cover panels which cover the filler material and the profile frame. The profile frame comprises a profile section having an axially symmetrical cross-section which forms a groove-like recess in which a connector element is frictionally engagingly insertable and arrestable. In a building construction system with construction elements erected, the construction elements are fastened on one side to a framework, connected with another construction element on the opposite side by the connector element and supported on the edge of the third side. These construction elements can be assembled in the manner of a construction set, for instance like a child's toy (Lego) and the requirements for tools and plant are very modest.

29 Claims, 7 Drawing Figures

PANEL CONSTRUCTION ELEMENT AND BUILDING CONSTRUCTION SYSTEM EMPLOYING SUCH CONSTRUCTION ELEMENTS

BACKGROUND OF THE INVENTION

The present invention broadly relates to panel construction elements and, more specifically, pertains to a new and improved construction of a panel construction element and of a building construction system employing such panel construction elements.

Generally speaking, the panel construction element of the present invention comprises at least one profile frame which forms a recess at its outer periphery in which a connector element for making a connection to adjacent construction elements is insertable, filler material arranged within the profile frame, and at least two cover panels which cover the profile frame and the filler material. The present invention especially relates to a construction element forming a facade element and a building construction system employing such construction elements.

In conventional building construction and building systems, building or construction panels are erected with joints and are fastened to the load-carrying or bearing construction. The pre-fabricated construction panels can, for instance, be made of gas concrete or foamed concrete and so forth or can have a sandwich construction. Construction panels thus built up comprise a rigid frame, filler material arranged within the frame and two cover panels covering the filler material and the frame. The frame can be made of wood or of a profiled section. The frame comprises a recess at its edges in the form of a groove in which a spline interconnecting the construction panels is insertable. Such construction panels are fastened to the load-carrying or bearing construction by means of screws.

A disadvantage of such construction or of such construction systems is that the construction panels, especially facade elements, are deformed by temperature variations. If construction panels made of concrete are employed, their erection to the load-carrying or bearing construction is more involved. This is also true for their fastening. In applications as facade elements, a type of fastening must be employed which is not visible on the exterior. This is considerably more complicated to realize and therefore constitutes a further disadvantage.

SUMMARY OF THE INVENTION

Therefore, with the foregoing in mind, it is a primary object of the present invention to provide a new and improved construction of a panel construction element which does not exhibit the aforementioned drawbacks and shortcomings of the prior art constructions.

Another and more specific object of the present invention aims at providing a new and improved construction of a panel construction element of the previously mentioned type which can be pre-fabricated in various shapes or contours and can be delivered to the erection site and can be erected simply and with a minimum of expense.

Yet a further significant object of the present invention aims at providing a new and improved construction of a panel construction element of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the panel construction element of the present invention is manifested by the features that the profile frame comprises a plurality of frame components; each frame component comprises two first elastic portions defining an aperture of the recess and between which the connector element is clampable in frictional engagement; each frame component comprises two second portions protruding into the recess and on which the connector element is arrestable; and each frame component comprises two third portions in which components of a mounting arrangement for the panel construction element are movably and non-rotatably arranged.

A substantial advantage of the invention is that the panel construction elements are executed in lightweight construction and that parts or components of a mounting arrangement may be already included.

It is advantageous for the frame components to be fabricated from a plurality of pieces.

In a preferred embodiment of the invention, the frame component has an I-shaped cross section. The flanges are constructed as side portions upon whose external surfaces the cover panels are fastened and the first, second and third portions are formed on each flange beginning at a free end thereof.

A considerable saving in weight is thus achieved without appreciably reducing strength.

In order to connect the frame components with one another at their locations of mutual abutment, a right-angled fourth portion or wall member protruding inwardly from the flange is formed on each flange at the other free end thereof, such that a groove is defined in which a connecting member bridging the locations of abutment is inserted.

This has the advantage that the profile frame can be assembled and adapted without special effort.

The building construction system of the present invention is manifested by the features that the panel construction elements have abutting edges; the panel construction elements are mutually interconnected by at least one connector element at the abutting edges thereof; each profile frame defines a respective recess at the abutting edges of the panel construction elements; the connector element is inserted into the recesses such that the connector element contacts the two first portions of both profile frames and forms a frictionally engaging connection and is engaged and arrested by the two second portions of one of the two profile frames; the panel construction elements are subject to dimensional expansion; each panel construction element is fastened by the mounting arrangement on at least one side thereof such that the dimensional expansion of the panel construction elements is compensated by the connector elements; and a portion of the mounting arrangement being retained and secured against rotation in at least one of the profile frames.

This building construction has the advantage that the construction elements erected and fastened on one side are interconnected by the connector elements such that the dimensional expansion of the construction elements can be compensated or accommodated by the connector elements. It has the further advantage that a system is created by the construction of the profile frame and of the connector elements in which the construction elements can be assembled in the manner of a construction set, such as a child's toy (Lego) and that erection is substantially simplified.

In a preferred embodiment, a steel framework is present upon which the construction elements are fastened on one side and the connector elements are constructed as auxiliary system supports.

This results in a simplification of the steel framework which, in turn, leads to considerable savings in materials and costs.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
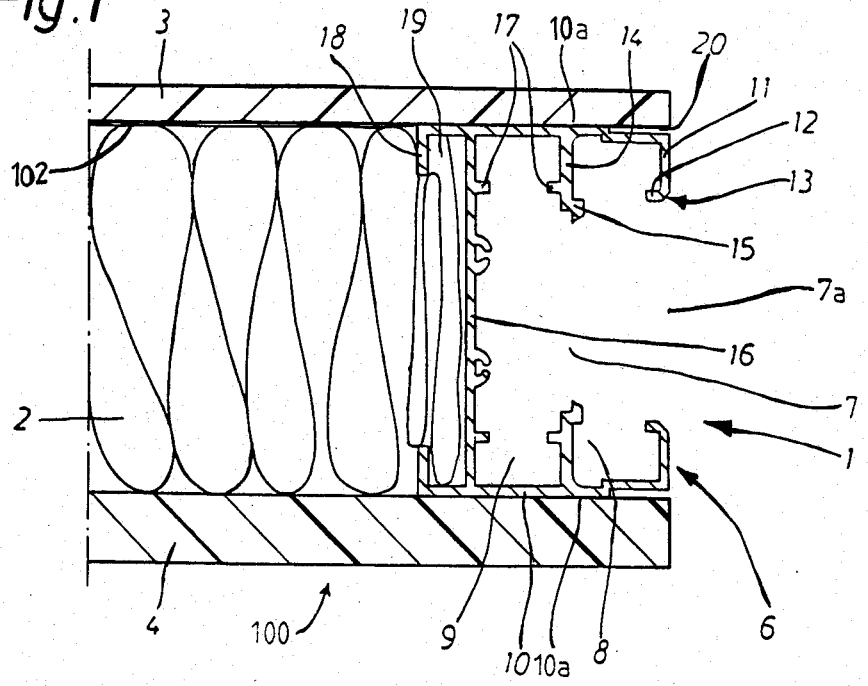
FIG. 1 schematically shows a section through a portion of an illustrative exemplary embodiment of a panel construction element according to the invention.

Describing now the drawings, it is to be understood that to simplify the showing thereof only enough of the structure of the panel construction element has been illustrated therein as is needed to enable one skilled in the art to readily understand the underlying principles and concepts of this invention. The invention will be described in relation to an exemplary construction having rectangular facade panels, but it is to be understood that such panels may also be triangular or polygonal. Turning now specifically to FIG. 1 of the drawings, the construction illustrated therein by way of example and not limitation will be seen to comprise a panel construction element incorporating a profile frame 1, a filler material 2 arranged within the profile frame 1 and two cover panels 3 and 4 which cover the filler material 2 and the profile frame 1. A layer of building paper may be installed between the cover panel 3 and the filler material 2.

Figure 2:
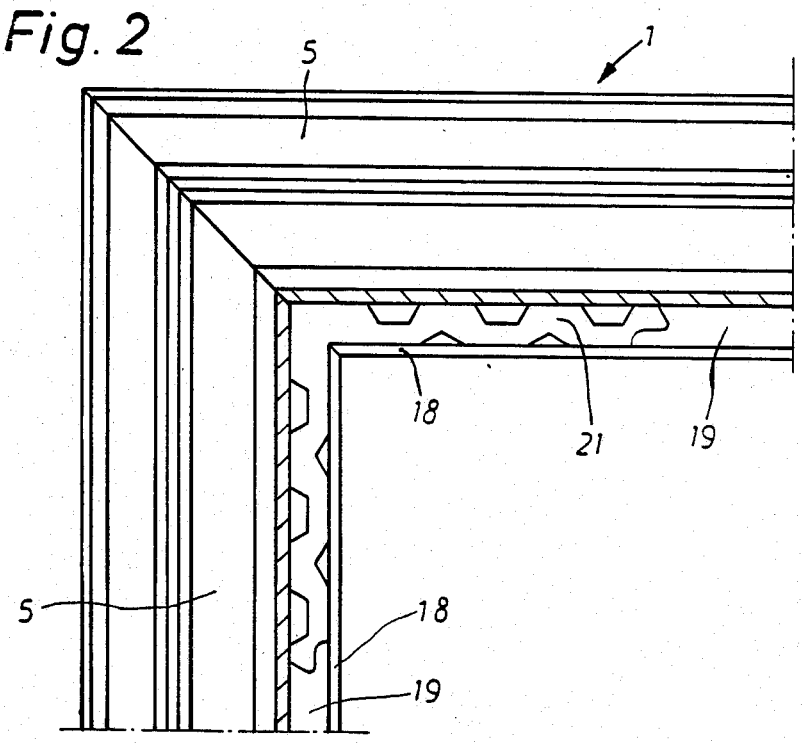
FIG. 2 schematically shows a view of a corner connection of the profile frame.

The profile frame 1 comprises four frame components 5 (two of which are shown in FIG. 2) made from an semifabricated profile or profiled section with an axially symmetrical cross-section. This profiled section is made of light metal, such as aluminum. It can, however be made of another metal or of plastic or other suitable material. As shown in FIG. 1, the cover panels 3 and 4 are differently constructed, i.e. as a facade panel 3 and an interior panel 4. The facade panel 3, is for instance, a plastic panel such as the one available under the trademark INKALITE®, while the interior panel, for instance is a plastic panel such as the one available under the trademark FERMACELL®. The filler material is, for instance, made of mineral wool, glass fibre or the like. The layer of building paper may comprise, for instance, a layer of Kraft Paper.

Due to the axially symmetrical cross-section of the frame components 5, each profile frame 1 comprises two elastic portions 6 which define the aperture 7*a* of a groove-like recess 7, two second portions 8 which extend into the recess 7, and two third portions 9 in which components of a mounting arrangement for the panel construction element are arranged.

As can be seen in FIG. 1, the profile section included in the profile frame 1 has a substantially I-shaped cross-section. Flanges 10 thereof form side portions 10*a* upon which the two cover panels 3 and 4 are fastened by means of not particularly shown conventional screws.

The first portion 6 which defines the recess 7 comprises a first wall member 11 which is constructed to protrude inwardly substantially at a right angle to the side portion 10*a* and a second wall member 12 which is constructed substantially parallel to the side portion 10*a* and protrudes inwardly. In the region of the aperture or mouth 7*a* of the recess 7 there is a sloping surface 13. A second portion 8 is provided at a distance from this first portion 6 and comprises a third wall member 14 constructed perpendicularly and protruding inwardly on the side portion 9 as well as a hook-shaped portion 15 constructed on the free end of the third wall portion 14. The hook-shaped portion 15 extends into the recess 7.

A third portion 9 is formed by a portion of the profile web 16, the third wall member 14 of the second portion 8 and two ribs 17 oriented toward one another and constructed to protrude from the web 16 of the profile section or frame 1 and from the third wall member 14.

A fourth wall member 18 is constructed at the other free end of the flange 10 and protrudes inwardly from this flange 10 substantially at a right angle to define a groove 19.

As previously mentioned, the profile frame 1 comprises four frame components 5 which are, as shown in FIG. 2 for two of them, mitred and each connected with one another by connecting members or elements 21. This connecting member or element 21 is angle-shaped and is inserted into the groove 19 in the corner region of the profile frame 1. The frame components 5 are thus sufficiently securely held together. The retention can be improved in that the fourth wall member 18 is deformed or crimped.

As shown in FIG. 1, the side portion 10*a* is further configured in the region of the first portion 6 to have an inward step, so that a gap 20 between the side portions 10*a* and the cover panels 3, respectively 4, is present.

In the following, the employment of the previously described construction elements in a building construction or building system will be described in relation to FIGS. 3 through 5.

The building construction or system has a steel framework built upon a foundation.

Figure 3:
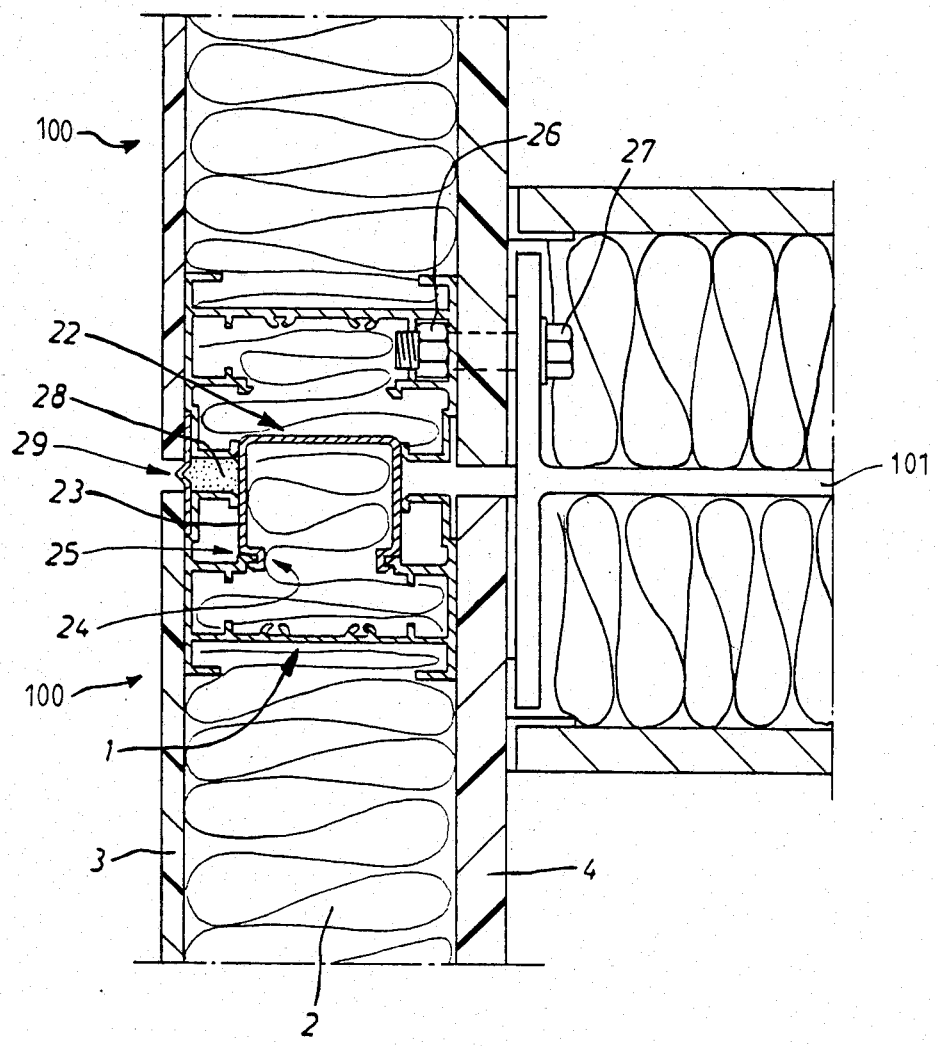
FIG. 3 schematically shows a section through a portion of an illustrative exemplary embodiment of a building construction according to the invention employing the panel construction elements according to FIG. 1.

FIG. 3 shows a section of the building construction where two panel construction elements 100 meet in the region of a steel support member 101.

Both panel construction elements 100 are interconnected at this location by a connector element 22. This connector element 22 has an axially substantially symmetrical cross-section and is made for instance of metal, such as for instance aluminum.

The connector element 22 is substantially U-shaped and retention portions 24 are provided at the free ends of its flanges 23. The retention portions 24 are hook-shaped and so configured that the hook aperture 25 is outwardly oriented.

In the panel construction elements 100 interconnected by the connector element 22, this connector element 22 contacts the second wall members 12 of both first portions 6 of both panel construction elements 100 with its flanges 23 and forms a frictionally engaging connection. The connector element 22 is in engagement with the second portion 8 of one profile frame 1 with its retention portion 24 and is therefore arrested. In order to facilitate the engagement of the retention portion 24 with the second portion 8 of the profile frame 1, sloping surfaces 13 are provided on the hook-shaped portions 24 and 15.

The panel construction elements 100 are fixed on one side to the steel framework 101. Bolts 27 and nuts 26 are employed for this purpose. The nuts 26 are arranged in the third portion 9 of the profile frame 1. This third portion 9 is designed such that it serves as storage means or magazine for the nuts 26, on the one hand, and as a wrench or spanner for these nuts 26, on the other hand. The one panel construction element 100 is connected with the other adjacent panel construction element 100 on the other side by the connector element 22 as previously described.

Dimensional changes of the panel construction elements 100 can be compensated or accommodated by this one-sided fastening of these panel construction elements, since the connector 22 can slide into the other profile frame 1.

The joints between the panel construction elements 100 are filled with an elastic sealant member or mass 28, for instance a foam rubber strip, and are then sealed with a cover or gasket strip 29 which is inserted into the gap 20 on both sides. This cover or gasket strip 29 is made, for instance, of rigid polyvinylchloride.

Figure 4:
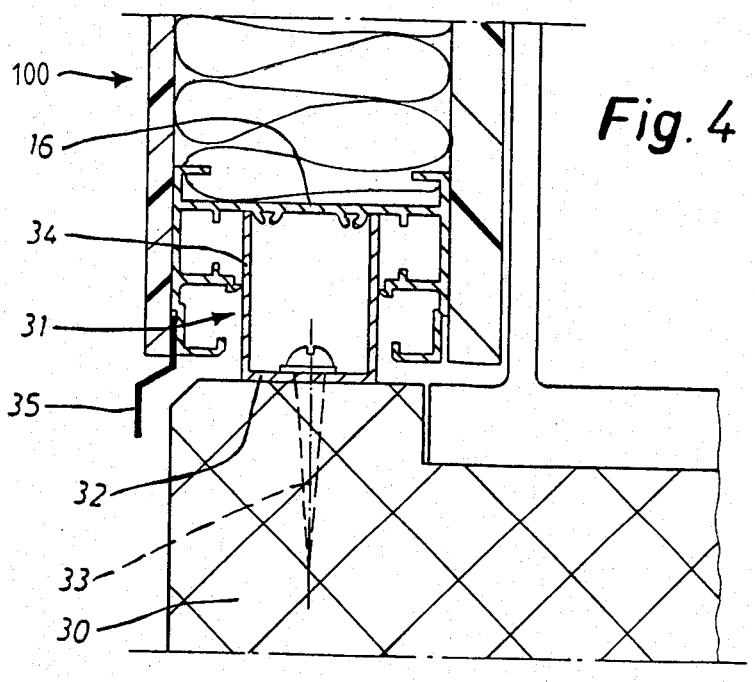
FIG. 4 schemetically shows a section through another portion of the building construction according to FIG. 3.
Figure 5:
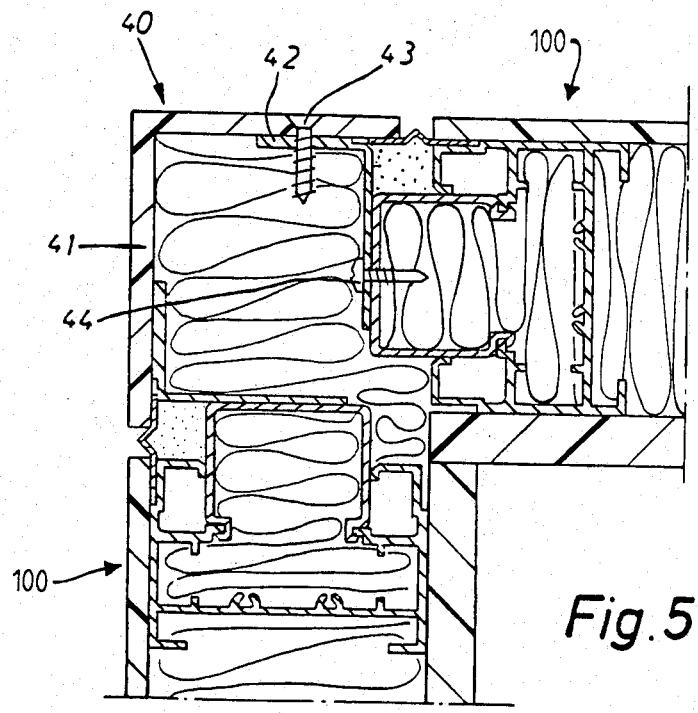
FIG. 5 schematically shows a section through the building construction in the region of a corner.

As shown in FIG. 4, the panel construction element 100 is supported on a channel or U-shaped profile 31 fastened to the foundation 30. This channel 31 is fastened by means of screws 33 with its web 32 resting on the foundation 30 such that the flanges 34 stand upright. The profile frame 1 bears with its web 16 upon the edges of the flanges 34.

The construction elements supported on the channel 31 are provided with a weather nose or coping 35 which is arranged in the gap 20 (cf. FIG. 1) between the profile frame 1 and the cover panel 3. The configuration of a corner 40 of the building construction or system is represented in FIG. 5. In order to be able to erect this corner 40, the appropriate panel construction elements 100 are provided with the connector elements 22. The corner 40 contains an L-shaped portion 41 preferably made from the same material as the cover panel 3 of the panel construction element 100 and a number of fastening angles 42 which are fastened to the L-shaped portion 41 by means of screws 43. The corner 40 proper is fastened to the connector elements 22 by means of screws 44.

As will be apparent from the preceding description, by employing the profile frame comprising a profile section with an axially symmetrical cross-section and a connector element, a system is created in which the panel construction elements can be assembled in the manner of a construction set, such as a child's toy (Lego) and in which the requirements for tools and erection plant are modest. It is furthermore possible to provide the construction element with forced panel ventilation.

Figure 6:
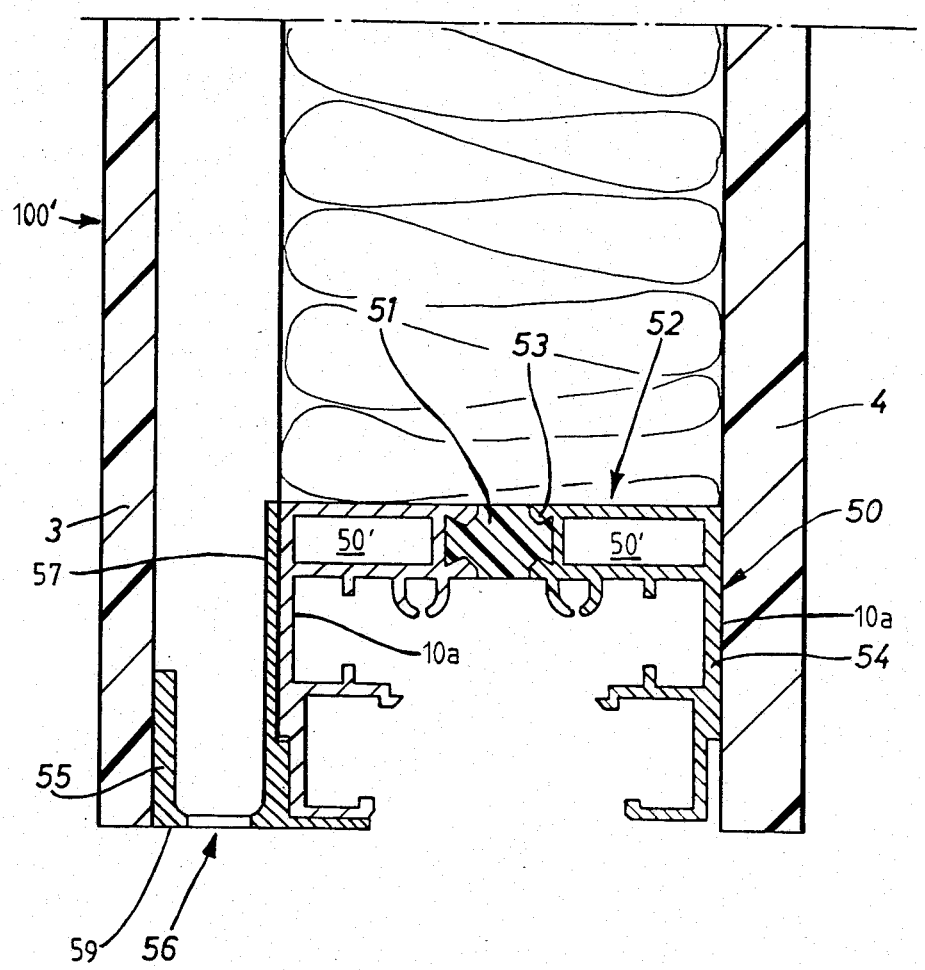
FIG. 6 schematically shows a section through a portion of a further illustrative exemplary embodiment of the panel construction element according to the invention.

The panel construction element 100' illustrated in FIG. 6 is constructed similarly to the panel construction element 100 represented in FIG. 1, so that in the following only the differences need be explained in detail.

As shown in FIG. 6, the frame component 5 is fabricated from a plurality of pieces and comprises two substantially I-shaped profiled sections 50 and a connecting component 51 which connects the profiled sections 50 such that a composite section or frame component 5, like in FIG. 2 having a U-shaped cross-section is formed. One flange 52 of the profiled section 50 is constructed with a double wall and comprises two ribs 53 protruding from the edge surface and which ribs 53 engage the connecting component 51, while the other flange 54 of the profiled section 50 forms the side portion **10*a* for fastening the cover panels 3 and 4**.

The first, second and third portions 6, 8 and 9 are constructed analogously to the embodiment according to FIG. 1 so that a description of the same can be forgone.

The doubled-walled construction of the flanges 52 forms two rectangular channels 50' in which a connecting member or element 21 can be inserted in order to connect the frame components 5 with one another.

As also shown in FIG. 6, the panel construction element 100' can comprise a substantially U-shaped profile frame 55 arranged between the cover panel 3 forming the facade panel and the profile frame 1 and is fastened to the side portion **10*a* by means of a flange 57. The second profile frame 55 is provided with orifices or holes 56 on its outer periphery in order to permit a panel ventilation of the wall or panel construction element 100'**.

Figure 7:
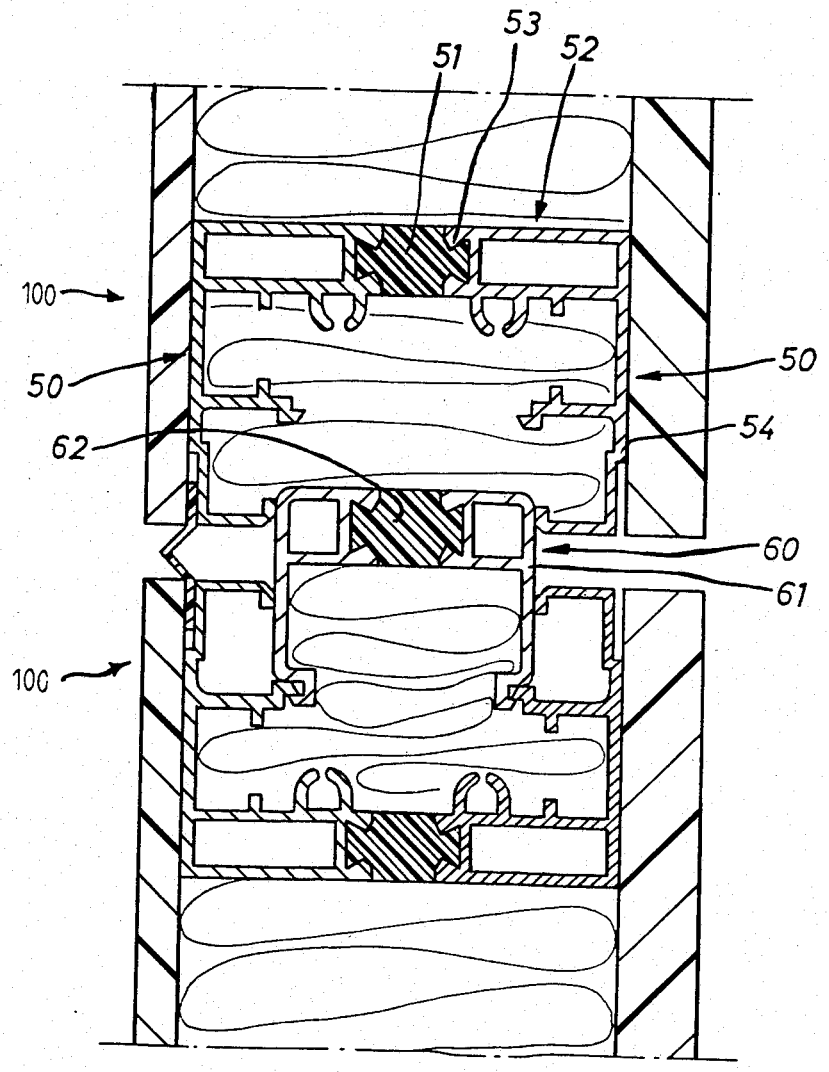
FIG. 7 schematically shows a section through a portion of a further illustrative exemplary embodiment of the building construction according to the invention.

As shown in FIG. 7, a connector element 60 is fabricated from a plurality of pieces in the manner of the frame components 5. The connector element 60 comprises two L-shaped profiled sections or angles 61 and a connecting component 62 in the manner of the frame component 5. The connecting component 62 unites the L-shaped profiled sections to form a connector element 60 having a U-shaped cross-section.

While the profiled sections 50 of the frame component 5 and 61 of the connector element 60 are made, for instance, of light metal for instance aluminum, the connecting component 62 is made, for instance of plastic, e.g. rigid polyvinylchloride.

While there are shown and described present preferred embodiments of the invention, it is to be distinctly understood that the invention is not limited thereto, but may be otherwise variously embodied and practiced within the scope of the following claims.

Accordingly, what I claim is:

1. A panel construction element, comprising:

at least one profile frame having a periphery;

said profile frame forming a recess at said periphery thereof for accommodating an insertable connector element for connecting two adjacent wall elements each defined by a panel construction element;

filler material arranged within said profile frame;

at least two cover panels for covering said profile frame and said filler material;

said profile frame comprising a plurality of frame components;

each said frame component comprising two elastic first portions defining an aperture of said recess and between which said connector element is clampable in frictional engagement;

each said frame component comprising two second portions protruding into said recess and on which said connector element is arrestable;

each said frame component comprising two third portions in which components of a mounting arrangement for the panel construction element are capable of being movably and non-rotatably arranged;

each said frame component having a substantially U-shaped cross-section comprising flanges constructed as side portions thereof;

said side portions each having an external surface and a free end;

said at least two cover panels being affixed to said external surface;

a respective one of said first, second and third portions being formed on each flange, beginning at said free end;

each said second portion comprising a wall member having a free end and protruding substantially at a right angle to one side portion of said side portions;

each said frame component having a web; and each said third portion comprising a portion of said web, said wall member of said second portion and two ribs oriented toward one another and protruding from said web and said wall member.

2. The panel construction element as defined in claim 1, wherein:

each said frame component has an axially symmetrical cross-section.

3. The panel construction element as defined in claim 1, wherein:

each said frame component is fabricated in one piece.

4. The panel construction element as defined in claim 1, wherein:

each said frame component is fabricated from a plurality of pieces.

5. The panel construction element as defined in claim 1, wherein:

each said frame component is made of both light metal and plastic.

6. The panel construction element as defined in claim 1, wherein:

each said frame component is made of light metal.

7. The panel construction element as defined in claim 1, wherein:

each said frame component is made of plastic.

8. The panel construction element as defined in claim 1, wherein:

each said first portion comprises a first wall member formed to extend substantially at a right angle to one side portion of said side portions;

each said first portion comprising a second wall member formed substantially parallel to said one side portion; and said second wall member being capable of being brought into contact with said connector element.

9. The panel construction element as defined in claim 1, wherein:

each said second portion comprises a third wall member defined by said wall member and having a free end and protruding substantially at a right angle to one side portion of said side portions;

each said second portion comprising a hooked portion formed on said free end of said third wall member; and said hooked portion being capable of being brought into engagement with said connector element.

10. The panel construction element as defined in claim 1, wherein:

said flanges formed as side portions are stepped in the region of said first portion in order to form a gap between said flanges formed as side portions and said cover panels.

11. The panel construction element as defined in claim 1, further including:

a layer of building paper;

said profile frame being made of light metal;

said filler material being made of glass fibers;

a first cover panel of said at least two cover panels being constructed as a facade panel;

a second cover panel of said at least two cover panels being constructed as an interior panel; and said layer of building paper being arranged between said cover panel forming said facade panel and said filler material.

12. The panel construction element as defined in claim 1, further including:

a layer of building paper;

said profile frame being made of light metal;

said filler material being made of mineral wool;

a first cover panel of said at least two cover panels being constructed as a facade panel;

a second cover panel of said at least two cover panels being constructed as an interior panel; and said layer of building paper being arranged between said cover panel forming said facade panel and said filler material.

13. A panel construction element, comprising:

at least one profile frame having a periphery;

said profile frame forming a recess at said periphery thereof for accommodating an insertable connector element for connecting two adjacent wall elements each defined by a panel construction element;

filler material arranged within said profile frame;

at least two cover panels for covering said profile frame and said filler material;

said profile frame comprising a plurality of frame components;

each said frame component comprising two elastic first portions defining an aperture of said recess and between which said connector element is clampable in frictional engagement;

each said frame component comprising two second portions having a wall member and protruding into said recess and on which said connector element is arrestable;

each said frame component comprising two third portions in which components of a mounting arrangement for the panel construction element are capable of being movably and non-rotatably arranged;

each said frame component having a substantially I-shaped cross-section comprising flanges constructed as side portions thereof;

said side portions each having an external surface and a free end;

said at least two cover panels being affixed to said external surface;

a respective one of said first, second and third portions being formed on each flange beginning at said free end;

each said second portion comprising a wall member having a free end and protruding substantially at a right angle to one side portion of said side portions;

each said frame component having a web; and each said third portion comprising a portion of said web, said wall member of said second portion and two ribs oriented toward one another and protruding from said web and said wall member.

14. The panel construction element as defined in claim 13, wherein:

each said first portion comprises a first wall member formed to extend substantially at a right angle to one side portion of said side portions;

each said first portion comprising a second wall member formed substantially parallel to said one side portion; and said second wall member being capable of being brought into contact with said connector element.

15. The panel construction element as defined in claim 13, wherein:

said flanges formed as side portions are stepped in the region of said first portion in order to form a gap between said flanges formed as side portions and said cover panels.

16. The panel construction element as defined in claim 13, wherein;

each flange of said flanges constructed as side portions having a free end has a further free end opposite said free end;

each said flange comprising a wall member formed on said further free end and protruding substantially at a right angle inwardly from said flange; and said wall member being formed to define a groove.

17. The panel construction element as defined in claim 16, further including;

a joining member;

said plurality of frame components adjoining one another to define abutting locations;

said joining member interconnecting said plurality of frame components at said abutting locations; and said joining member being held inserted in said groove.

18. A panel construction element, comprising:

at least one profile frame having a periphery;

said profile frame forming a recess at said periphery thereof for accommodating an insertable connector element for connecting two adjacent wall elements each defined by a panel construction element;

filler material arranged within said profile frame;

at least two cover panels for covering said profile frame and said filler material;

said profile frame comprising a plurality of frame components;

each said frame component comprising two elastic first portions defining an aperture of said recess and between which said connector element is clampable in frictional engagement;

each said frame component comprising two second portions protruding into said recess and on which said connector element is arrestable;

each said frame component comprising two third portions in which components of a mounting arrangement for the panel construction element are capable of being movably and non-rotatably arranged;

a second profile frame having an outer periphery and arranged between said cover panel forming said facade panel and said at least one profile frame, and said second profile frame comprising a plurality of orifices at said outer periphery thereof for panel-ventilating the panel construction element.

19. A building construction system comprising:

panel construction elements;

each panel construction element comprising:

at least one profile frame having a periphery;

at least two cover panels for covering said profile frame;

said profile frame comprising a plurality of frame components;

each said frame component comprising two elastic first portions defining a recess and between which a connector element is clampable in frictional engagement;

each said frame component comprising two second portions protruding into said recess and on which said connector element is arrestable;

each said frame component comprising two third portions in which components of a mounting arrangement for the panel construction elements are capable of being movably and non-rotatably arranged;

each said frame component having a substantially U-shaped cross-section comprising flanges constructed as side portions thereof;

each said second portion comprising a wall member having a free end and protruding substantially at a right angle to one side portion of said side portions;

each said frame component having a web;

each said third portion comprising a portion of said web, said wall member of said second portion and two ribs oriented toward one another and protruding from said web and said wall member;

said panel construction elements having adjacent edges;

at least one connector element for mutually interconnecting said panel construction elements at said adjacent edges thereof;

each said at least one profile frame defining said recess at said adjacent edges of said panel construction elements;

said connector element being inserted into said recesses such that said connector element contacts said two first portions of two adjacent profile frames and forms a frictionally engaging connection and is engaged and arrested by said two second portions of one of said profile frames;

said panel construction elements being subject to dimensional expansion;

each said panel construction element being fastened by said mounting arrangement on one side thereof such that said dimensional expansion of said panel construction elements is compensated by said connector elements; and a component of said mounting arrangements being retained and secured against rotation in its related profile frame.

20. The building construction system as defined in claim 19, wherein:

said connector element has an axially symmetrical cross-section.

21. The building construction system as defined in claim 19, wherein:

said connector element is fabricated in one piece.

22. The building construction system as defined in claim 19, wherein:

said connector element is fabricated from a plurality of pieces.

23. The building construction system as defined in claim 19, wherein;

said connector element is made of both light metal and plastic.

24. The building construction system as defined in claim 19, wherein;

said connector element is made of light metal.

25. The building construction system as defined in claim 19, wherein;

said connector element is made of plastic.

26. The building construction system as defined in claim 19, wherein:

said connector element has a substantially U-shaped cross-section comprising flanges with free ends; and said connector element being provided with retaining portions at said free ends thereof.

27. The building construction system as defined in claim 26, wherein:

said retaining portions are formed with a hook shape defining an aperture; and said hook shape being oriented outwardly such that said second portion of a respective profile frame engages said aperture.

28. The building construction system as defined in claim 19, further including:

a cover element;

said panel construction elements defining at least one joint;

said joint being filled with an elastic member;

said elastic member being covered by said cover element; and said cover element being inserted into a gap provided in said panel construction.

29. The building construction system as defined in claim 19, further including:

a steel framework;

each said panel construction element being fastened to said steel framework on one side; and said connector element being constructed as an auxiliary system support.

* * * * *